US011753927B2

(12) United States Patent
Alruwaili et al.

(10) Patent No.: US 11,753,927 B2
(45) Date of Patent: Sep. 12, 2023

(54) COLLAPSE PRESSURE IN-SITU TESTER

(71) Applicant: SAUDI ARABIAN OIL COMPANY, Dhahran (SA)

(72) Inventors: Khalid Mohammed Alruwaili, Dammam (SA); Murtadha J. AlTammar, Al Olaya (SA); Khaqan Khan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/456,325

(22) Filed: Nov. 23, 2021

(65) Prior Publication Data

US 2023/0160296 A1 May 25, 2023

(51) Int. Cl.
*E21B 47/06* (2012.01)

(52) U.S. Cl.
CPC ..... *E21B 47/06* (2013.01)

(58) Field of Classification Search
CPC ..... E21B 47/00; E21B 47/06; E21B 49/00; E21B 49/006; E21B 47/10; E21B 47/107
See application file for complete search history.

(56) References Cited

U.S. PATENT DOCUMENTS

| | | | |
|---|---|---|---|
| 3,388,741 | A | 6/1968 | Jensen |
| 5,092,167 | A | 3/1992 | Finley et al. |
| 6,480,118 | B1 | 11/2002 | Rao |
| 2002/0046835 | A1 | 4/2002 | Lee et al. |
| 2003/0094281 | A1 | 5/2003 | Tubel |
| 2004/0141420 | A1 | 7/2004 | Hardage et al. |
| 2006/0191332 | A1 | 8/2006 | Manin et al. |
| 2012/0057432 | A1 | 3/2012 | Hill et al. |

(Continued)

FOREIGN PATENT DOCUMENTS

| | | | | |
|---|---|---|---|---|
| WO | 97/21116 | A1 | 6/1997 | |
| WO | WO-9721116 | A1 * | 6/1997 | ..... G01V 1/40 |
| WO | 2016/164826 | A1 | 10/2016 | |

OTHER PUBLICATIONS

Tang, Bin et al., "Application of Distributed Optical Fiber Sensing Technology in Surrounding Rock Deformation Control of TBM-Excavated Coal Mine Roadway"; Journal of Sensors; vol. 2018, Article ID 8010746; pp. 1-10; Feb. 22, 2018 (11 pages).

(Continued)

*Primary Examiner* — Caroline N Butcher
(74) *Attorney, Agent, or Firm* — Osha Bergman Watanabe & Burton LLP

(57) ABSTRACT

A method and an apparatus for determining a collapse pressure of a well using a drill stem test tool (DSTT). The method includes isolating a zone of interest in the wellbore, then reducing and recording pressure inside the drill string while recording acoustic emissions from the sensors on the DSTT, then correlating the recordings of the acoustic emissions with the pressure. The method includes using the processed acoustic emissions to determine a candidate sound of interest and a pressure at which the candidate sound of interest is recorded, then comparing the candidate sound of interest with a reference lookup table of known lithology classifications. The method includes determining a collapse pressure of the wellbore using the lithology of the wellbore and the pressure at which the candidate sound of interest is recorded.

16 Claims, 5 Drawing Sheets

(56) References Cited

U.S. PATENT DOCUMENTS

| | | | | |
|---|---|---|---|---|
| 2013/0192359 | A1 | 8/2013 | Pelletier et al. | |
| 2018/0334903 | A1 | 11/2018 | Lehr et al. | |
| 2019/0100993 | A1* | 4/2019 | Sullivan | E21B 47/013 |
| 2019/0226956 | A1* | 7/2019 | Alruwaili | E21B 49/006 |
| 2021/0003003 | A1 | 1/2021 | Proett et al. | |
| 2021/0215033 | A1 | 7/2021 | Jones et al. | |

OTHER PUBLICATIONS

International Search Report and Written Opinion of the International Searching Authority issued in corresponding International Application No. PCT/US2022/050851, dated Mar. 27, 2023 (14 pages).

* cited by examiner

COLLAPSE PRESSURE IN-SITU TESTER

BACKGROUND

Fluids are typically produced from a reservoir in a subterranean formation by drilling a wellbore into the subterranean formation, establishing a flow path between the reservoir and the wellbore, and conveying the fluids from the reservoir to the surface through the wellbore. Fluids produced from a hydrocarbon reservoir may include natural gas, oil, and water.

Drilling the wellbore typically uses a drilling system disposed to penetrate from the earth's surface or from the seabed to the formation. Drilling the wellbore uses a drill bit that removes rock in the form of cuttings. The drill bit is deployed by and rotated by a pipe termed a drill string. A drilling fluid called mud is disposed by pumping it through the drill string and out the drill bit to lubricate the bit and to carry the cuttings up and out of the wellbore. The mud also provides hydrostatic pressure to help stabilize the wellbore; to prevent the wellbore from collapsing in on itself. The mud is specified to a tailored hydrostatic pressure window bounded by a range with an upper limit to prevent over pressuring the rock and thus fracturing the formation, and with a lower limit to prevent the bore collapsing. The lower limit for the mud weight is termed the collapse mud weight.

In some formation lithologies the hydrostatic pressure range is wide and in some narrow. To determine the lower bounds of the pressure window, an improved drill stem test tool (DSTT) is deployed to test collapse pressure in-situ.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for improving production performance of a well using a drill stem test tool (DSTT). The method includes deploying the DSTT via a drill string into a wellbore, the DSTT including a plurality of sensors. The method includes isolating, using straddle packers, a zone of interest in the wellbore, then reducing and recording pressure inside the drill string which is in fluid communication with the wellbore. The method includes recording acoustic emissions from the plurality of sensors disposed on the DSTT in the zone of interest while reducing pressure inside the drill string, then correlating the recordings of the acoustic emissions with the pressure inside the drill string, and processing, using a computer processor, the acoustic emissions. The method includes using the processed acoustic emissions to determine a candidate sound of interest and a pressure at which the candidate sound of interest is recorded, then comparing the candidate sound of interest with a reference lookup table of known lithology classifications, and determining a lithology of the wellbore from the lookup table. The method includes determining a collapse pressure of the wellbore using the lithology of the wellbore and the pressure at which the candidate sound of interest is recorded.

A drill stem test tool (DSTT) disposed in a wellbore includes a drill string with perforations, an upper straddle packer and a lower straddle packer used to isolate a zone of interest in the wellbore and a pressure gauge with a memory for recording pressure. The pressure gauge is configured to measure pressure inside the drill string. The DSTT also includes acoustic sensors distributed along the length of the drill string. The acoustic sensors are configured to listen for acoustic emissions, including a candidate sound of interest in the isolated zone of interest, and record a pressure at which the candidate sound of interest is recorded. The DSTT is used to determine a collapse pressure of the wellbore using a lithology classification of the wellbore and the pressure at which the candidate sound of interest was recorded.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, or third) may be used as an adjective for an element (that is, any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements. Unless explicitly stated otherwise, components and functions are optional and may be combined or subdivided. Similarly, operations may be combined or subdivided, and their sequence may vary.

Many parameters affect the behavior of a wellbore during drilling including bottom hole pressure from the formation and from the hydrostatic head pressure from the drilling fluid called drilling mud. The column of mud within the drill string creates the hydrostatic head pressure. The hydrostatic head pressure from the mud is proportional to mud weight. Mud weight is adjusted by means of adjusting the mud density. A negative behavior during drilling is wellbore wall collapse and it is closely correlated to the mud weight. The bottom hole pressure at which the wellbore wall collapses is unique to every wellbore.

Embodiments disclosed herein relate to a method and system for determining the bottom hole pressure at which the wellbore wall collapses. From the calculated bottom hole pressure, embodiments disclosed herein determine the optimum mud weight to prevent collapse of the wellbore or to cause fracture of the formation. More specifically, embodiments disclosed herein provide direct measurement of the collapse pressure based on an acoustic emission of the geological formation. This pressure is extremely important to design an optimum mud weight during drilling of problematic formations.

Figure 1:
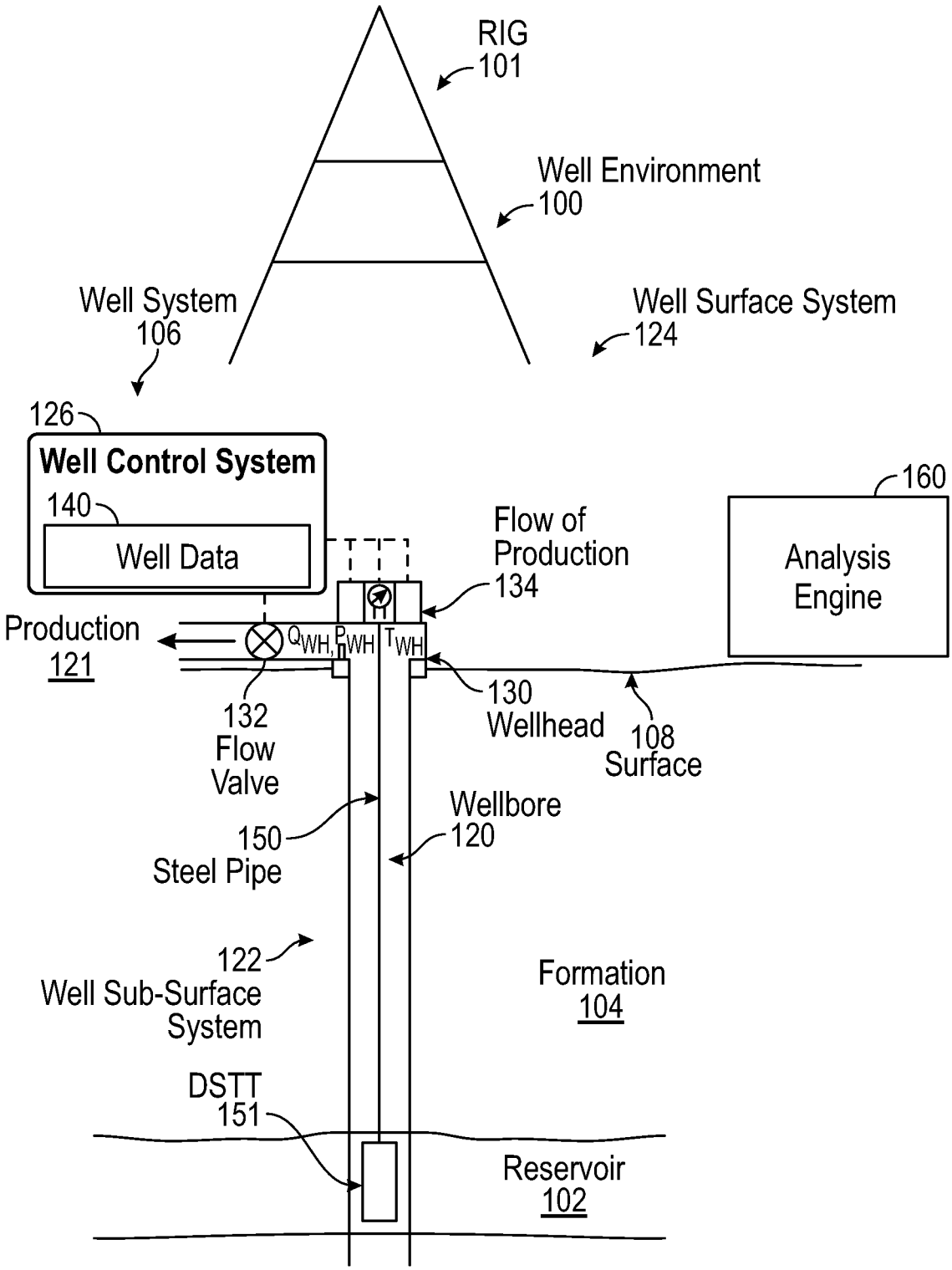
FIG. 1 shows a system in accordance with one or more embodiments.

FIG. 1 shows a schematic diagram in accordance with one or more embodiments. As shown in FIG. 1, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a well sub-surface system (122), a well surface system (124), and a well control system (126). The well control system (126) may control various operations of the well system (106), such as well production operations, well drilling operation, well completion operations, well maintenance operations, and reservoir monitoring, assessment, and development operations. In some embodiments, the well control system (126) includes a computer system that is the same as or similar to that of computer system (502) described below in FIG. 5 and the accompanying description.

The rig (101) is the machine used to drill a borehole to form the wellbore (120). Major components of the rig (101) include the drilling fluid tanks, the drilling fluid pumps (e.g., rig mixing pumps), the derrick or mast, the draw works, the rotary table or top drive, the drillstring, the power generation equipment, and auxiliary equipment.

The wellbore (120) includes a bored hole (i.e., borehole, wellbore) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production ("production") (121) (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations (e.g., during in situ logging operations). This wellbore (120) is one example of the type of wellbore for which the collapse pressure is calculated using embodiments disclosed herein, to prevent collapse of the wellbore (120).

In some embodiments, during operation of the well system (106), the well control system (126) collects and records well data (140) for the well system (106). During drilling operation of the well system (106), the well data (140) may include mud properties, flow rates, drill volume and penetration rates, formation characteristics, etc. The well data (140) may also include measurements obtained using the downhole investigation tool depicted in FIG. 5 below. In some embodiments, the well data (140) are recorded in real-time, and are available for review or use within seconds, minutes, or hours of the condition being sensed (e.g., the measurements are available within one hour of the condition being sensed). In such an embodiment, the well data (140) may be referred to as "real-time" well data (140). Real-time well data (140) may enable an operator of the well system (106) to assess a relatively current state of the well system (106), and make real-time decisions regarding development of the well system (106) and the reservoir (102), such as on-demand adjustments in drilling fluid and regulation of production flow from the well.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more flow valves (132) that are operable to control the flow of production (134). For example, a flow valve (132) may be fully opened to enable unrestricted flow of production (121) from the wellbore (120), the flow valve (132) may be partially opened to partially restrict (or "throttle") the flow of production (121) from the wellbore (120), and flow valve (132) may be fully closed to fully restrict (or "block") the flow of production (121) from the wellbore (120), and through the well surface system (124).

In some embodiments, the wellhead (130) includes a choke assembly. For example, the choke assembly may include hardware with functionality for opening and closing the fluid flow through pipes in the well system (106). Likewise, the choke assembly may include a pipe manifold that may lower the pressure of fluid traversing the wellhead. As such, the choke assembly may include a set of high-pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system (126). Accordingly, a well control system (126) may obtain wellhead data regarding the choke assembly as well as transmit one or more commands to components within the choke assembly in order to adjust one or more choke assembly parameters.

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature, and flow rate of production (121) flowing through the wellhead (130), or other conduits of the well surface system (124), after exiting the wellbore (120). The surface sensing system (134) may also include sensors for sensing characteristics of the rig (101), such as bit depth, hole depth, drilling fluid flow, hook load, rotary speed, etc.

Figure 3:
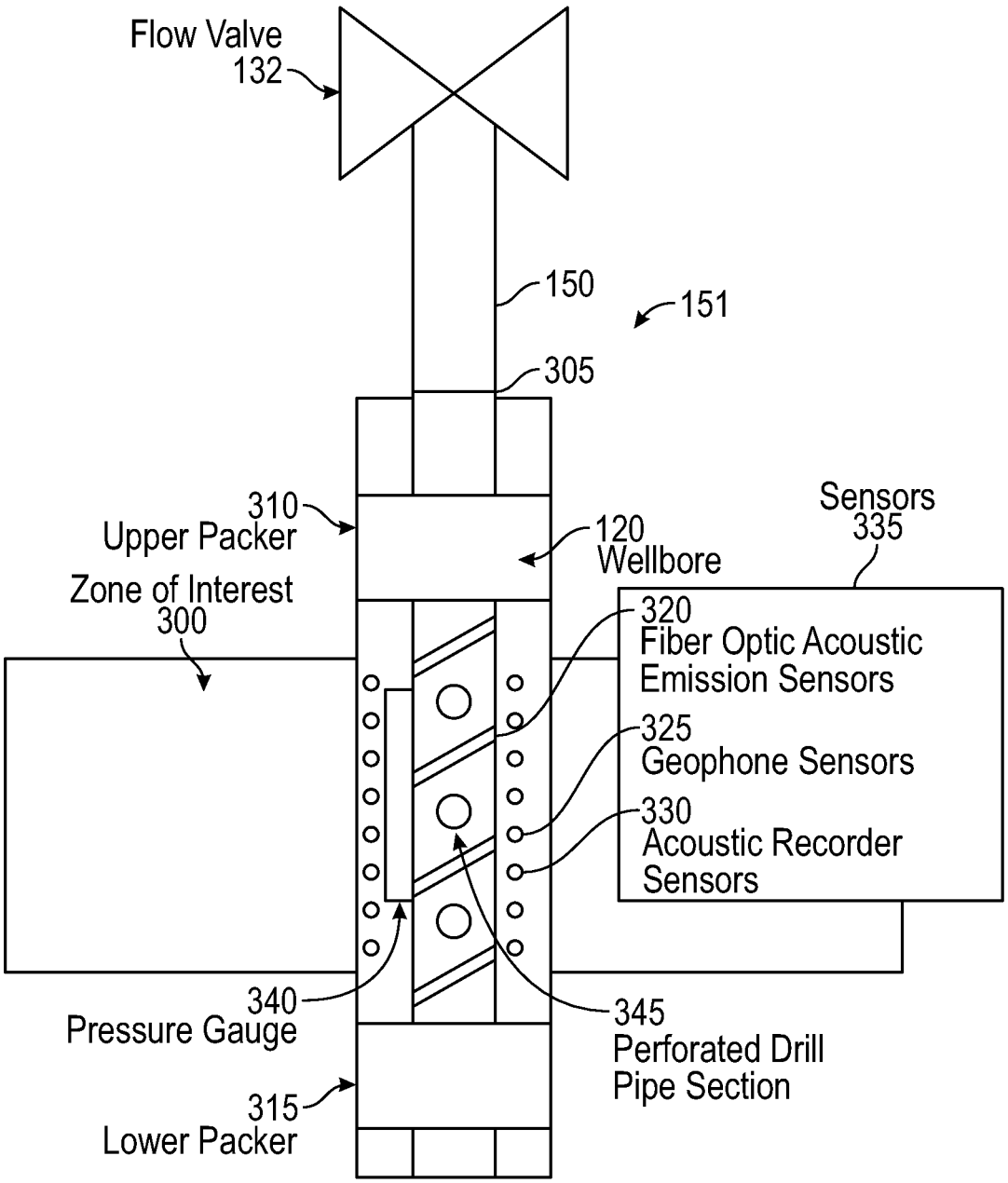
FIG. 3 shows an example DST tool in accordance with one or more embodiments.

In some embodiments, the well system (106) is provided with a downhole investigation tool (151) attached to a drill string (150) to deploy into and suspend in the wellbore (120) for the purposes of well drilling, well testing, or other reasons. For example, the downhole investigation tool (151) may comprise a drill stem test tool (DSTT) as depicted in FIG. 3 below.

In some embodiments, the well system (106) is provided with an analysis engine (160) that includes hardware and/or software with functionality for processing the measurements and other information obtained using the downhole investigation tool (151), such as the DSTT depicted in FIG. 3 below.

While the analysis engine (160) is shown at surface at a well site, in some embodiments, the analysis engine (160) is located downhole within a downhole investigation tool, or away from the well site, such as in the Cloud over the Internet, or in the Edge or Fog, or a combination. In some embodiments, the analysis engine (160) may include a computer system that is similar to the computer system (502) described below with regard to FIG. 5 and the accompanying description.

Figure 2:
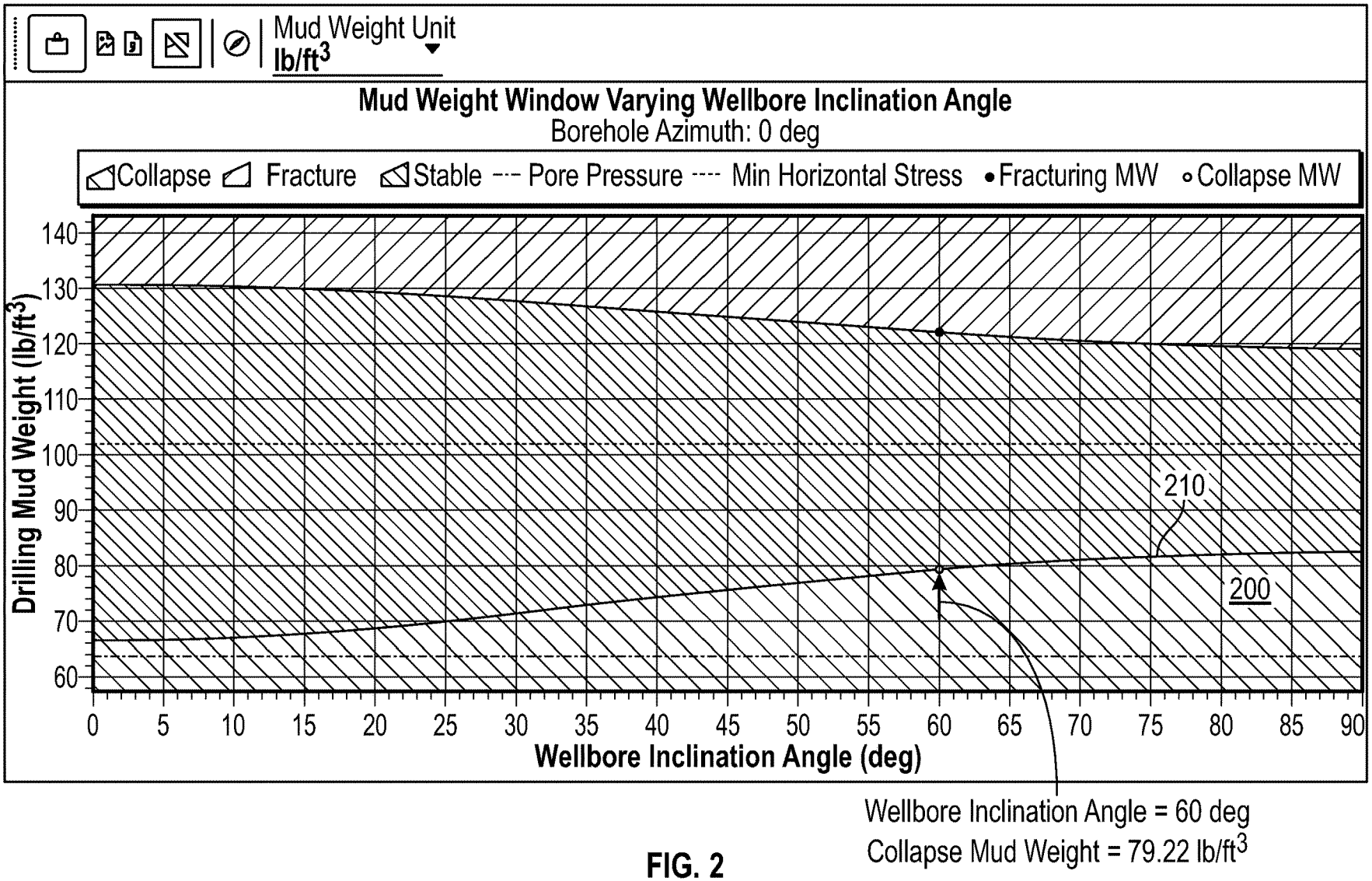
FIG. 2 shows a graph of a mud weight hydrostatic pressure window in accordance with one or more embodiments.

FIG. 2 shows the pressure window between collapse pressure and fracture pressure. The collapse pressure (200) in FIG. 2 is shown as an area defined by Wellbore Inclination Angle on the x-axis, Collapse Mud Weight on the y-axis, and below the collapse pressure gradient (210). When the wellbore pressure reduces to the collapse pressure gradient, a fiber optic acoustic emission sensor measures the rock deformation. The fiber optic line is used to detect induced acoustic emissions from the geological formation in real-time at the location of the sensor within the wellbore.

Turning to FIG. 3, FIG. 3 illustrates a downhole investigation tool suspended in the wellbore in accordance with one or more embodiments disclosed herein. In one or more embodiments, one or more of the modules and/or elements shown in FIG. 3 may be omitted, repeated, combined, and/or substituted. Accordingly, embodiments disclosed herein should not be considered limited to the specific arrangements of modules and/or elements shown in FIG. 3.

In one or more embodiments, FIG. 3 shows a downhole investigation tool such as an improved downhole drill stem test tool (DSTT) (151). As shown in FIG. 3, the DSTT (151) is attached to a steel pipe (150), such as a drill string, and suspended in the wellbore (120). The steel pipe (150) is fluidly connected to the flow valve (132). The DSTT includes a section of perforated pipe (345) coaxially attached to the steel pipe (150). The perforated pipe (345) is in fluid communication with the wellbore (120). Inside the wellbore (120), the upper (310) and lower (315) straddle packers inflate to isolate a target zone of interest (300) of the formation (104), such as the reservoir (102).

In one or more embodiments, the downhole investigation tool (151) includes one or more fiber optic acoustic emission sensors (320), one or more geophone sensors (325), one or more acoustic recorder sensors (330), (hereafter "sensors" (335)), a pressure gauge (340), a mechanical attachment (305), and one or more computer memories (506) that hold data. The mechanical attachment (305) is any mechanism configured to securely attach the downhole investigation tool (151) to the steel pipe (150) in the wellbore. The sensors (335) listen to the sound of the wellbore (120). The acoustic emissions (in digital form—data) are transmitted to the surface (e.g., the analysis engine (160) depicted in FIG. 1 above) for processing.

Drilling a wellbore into rock ideally results in a uniformly cylindrical bored hole (borehole, wellbore.) As the hole gets deeper, the surrounding rock applies a stress to the wall of the hole, the wellbore wall. If the stress in the wellbore wall exceeds the tensile strength of the wellbore rock, then a portion of the wellbore wall will break off and fall into the wellbore. The void remaining in the wellbore wall from where the portion of the wellbore wall broke off is termed wellbore breakout and the event is termed wellbore collapse.

To stabilize the rock wall and thus the wellbore, the drilling mud is disposed in the well through the drill string. The hydrostatic head pressure counteracts the stress applied to the wall of the wellbore. If the hydrostatic head pressure plus the tensile strength of the rock fall below the stress in the wellbore, then again, the portion of the wellbore wall will break off causing the wellbore breakout.

Determining the mud density to obtain the best mud weight to prevent breakout can be done using analytical techniques. If the calculated mud weight is too low, then breakout may occur. To evaluate whether or not the breakout has occurred, a separate investigation tool must be run in the wellbore. Embodiments disclosed herein provide direct measurement of the collapse pressure without running a separate investigation tool in the wellbore.

The breakout may be triggered by reducing the bottom hole pressure to cause the rock to collapse. The breakout causes an acoustic emission. The following method may induce the acoustic emission. A drill stem test is performed. The drill stem test is an oilfield investigation technique used to determine the disposition of wells and to provide reservoir data that aid in predicting productivity and appropriate well completion techniques (Per AIFE.) The drill stem test uses the DSTT positioned in the wellbore at the target zone of the formation (104), such as the reservoir (102), hereafter zone of interest. After isolating the zone of interest, the flow valve (132) is opened, reducing the pressure inside the drill string and causing the fluid to flow out of the geological formation up to the surface.

The acoustic emission is recorded and monitored during the pressure depletion using downhole sensors and surface equipment. For example, downhole sensors for receiving acoustic emissions may process and/or transmit the data to the surface for processing. Sensors may listen periodically or continuously for acoustic emissions. The recorded sounds may include, or otherwise represent, breakout in the wellbore. The recordings of the acoustic emissions are correlated with the pressure inside the drill string by recording the time at which the acoustic emissions and the pressure are recorded. The acoustic emissions are detected by the DSTT which is communicably coupled with the computer system in which the acoustic emissions are recorded. In an alternative embodiment, the DSTT records the acoustic emission, the pressure, and the time record within the memory of the DSTT. The DSTT is recovered to the surface and the recorded data retrieved from the DSTT. The breakout may eventually be induced as the pressure is continually reduced. The breakout is captured by the recorded acoustic emission. The rock failure may be observed by analyzing the acoustic emission data. In one or more embodiments, the rock failure acoustic emission is arranged for cooperation with the measured downhole pressure. The pressure magnitude at which the breakout acoustic emission occurs will be used to determine the critical collapse pressure for mud weight design.

Figure 4:
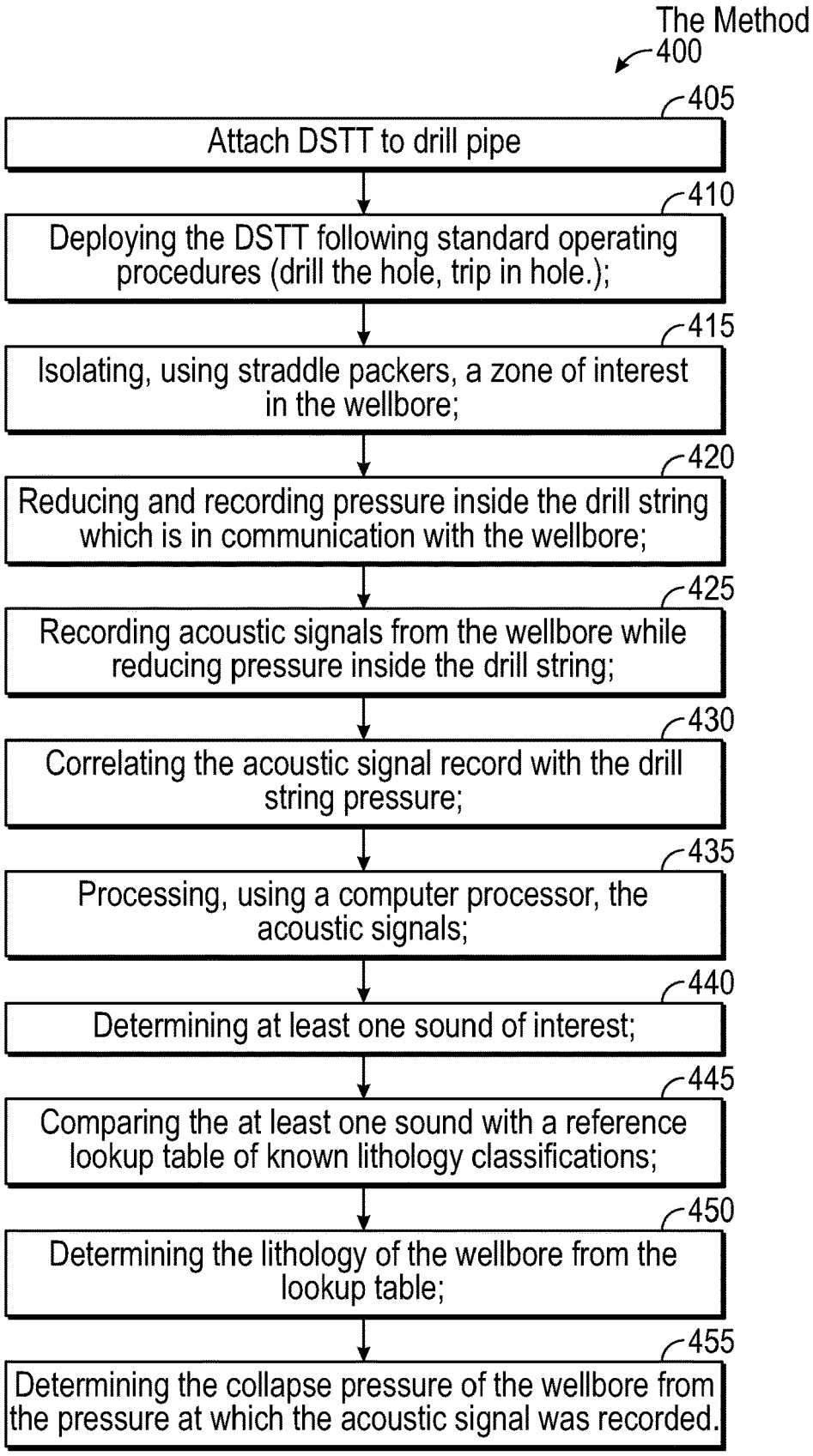
FIG. 4 shows a flowchart in accordance with one or more embodiments.

In one or more embodiments, turning to FIG. 4, FIG. 4 shows a process flowchart (400) in accordance with one or more embodiments. One or more blocks in FIG. 4 may be performed using one or more components as described in FIGS. 1 and 3. While the various blocks in FIG. 4 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

Initially in Block 405, a downhole investigation tool, for example, DSTT (151) is attached to the steel pipe (e.g., drill pipe or drill string) of the wellbore.

In Block 410, the DSTT is deployed in the wellbore to the zone of interest by descending the steel pipe and DSTT into the wellbore using the well system (106).

In Block 415, two straddle packers are activated using the well system to isolate the zone of interest in the wellbore. In one or more embodiments, the DSTT is conducted on an openhole in the isolated zone of interest.

In Block 420, the drill string pressure is recorded while the pressure is reduced by opening the flow valve (132). The perforated pipe attached to the drill string is in fluid communication with the wellbore. The open flow valve allows the mud to flow out of the wellbore and thus reduce the pressure in the zone of interest.

In Block 425, the sensors on the DSTT record acoustic emissions while the pressure is reduced. The pressure is reduced until an acoustic emission is detected or until the minimum flowing wellhead pressure is reached. Those skilled in the art will appreciate that the value to which pressure is reduced is variable based on the type of formation to enable collapse of the borehole wall.

In Block 430, the recordings of the acoustic emissions are correlated with the pressure inside the drill string by recording the time at which the acoustic emissions and the pressure are recorded. The acoustic emissions are detected by the DSTT which is communicably coupled with the computer system in which the acoustic emissions are recorded. The DSTT is recovered to the surface and the recorded data retrieved from the DSTT In Block 435, the computer processor processes the acoustic emissions using the computer system. The computer system may correlate the sensor data (i.e., acoustic emission signals/measurements) with known acoustic sounds and determines when the acoustic emission exceeds or meets a predefined threshold for a sound that could potentially be collapsing wall. The process may compare the amplitude of the acoustic emission with that of threshold amplitudes to detect one that is above the threshold.

In Block 440, the processed acoustic emissions are used to determine a candidate sound of interest, such as the acoustic emission, and a pressure at which the candidate sound of interest is recorded. The candidate sound of interest may be any sound that indicates collapse of the wellbore. Thus, the acoustic emissions are used to listen for a sound that may indicate wellbore collapse.

In Block 445, the candidate sound of interest is compared, using the computer processor, with a reference lookup table of known lithology classifications stored in the computer or stored in the DSTT.

In Block 450, a lithology classification of the wellbore ("lithology"), such as shale is determined from the lookup table.

In Block 455, using the lithology classification and the pressure at which the acoustic emission of the candidate sound of interest was recorded, a collapse pressure of the wellbore is determined. After Block 455, the packers are deflated and the wellbore pressure is increased.

Although not shown in FIG. 4, the method of FIG. 4 may be repeated for different formations and different isolated zones of interest.

Figure 5:
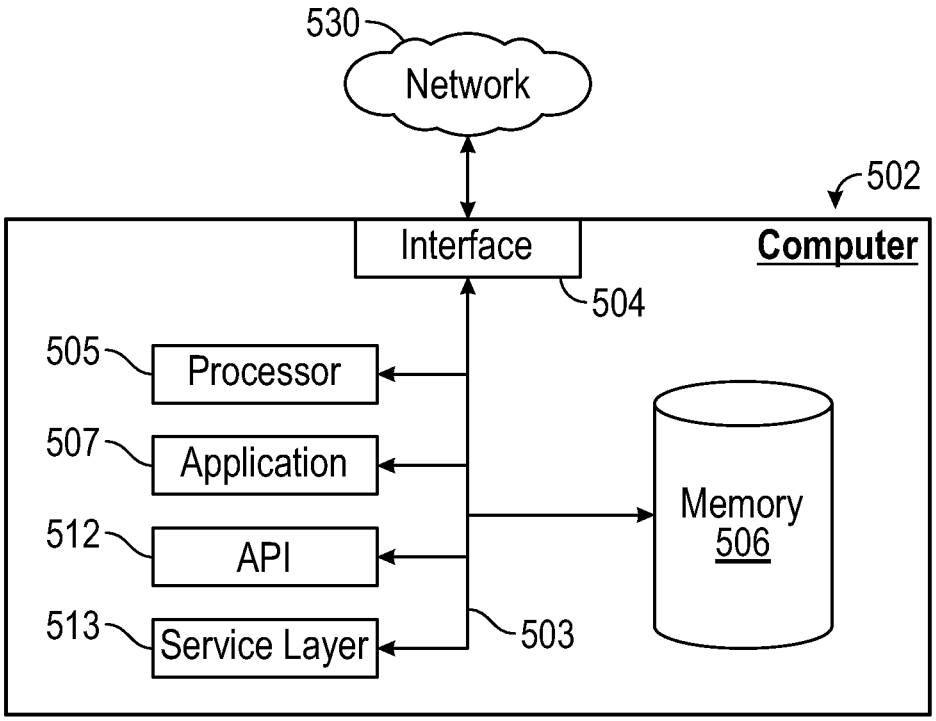
FIG. 5 shows a computing system in accordance with one or more embodiments.

Embodiments disclosed herein may be implemented on a computer system. FIG. 5 is a block diagram of a computer system (or computing device) (502) used to provide computational functionalities associated with described algorithms, methods, functions, processes, flows, and procedures as described in the instant disclosure, according to an implementation. The illustrated computer (502) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include an input device, such as a keypad, keyboard, touch screen, or other device that can accept user information, and an output device that conveys information associated with the operation of the computer (502), including digital data, visual, or audio information (or a combination of information), or a GUI. The output device may include a screen (e.g., a liquid crystal display (LCD), a plasma display, a light emitting diode (LED) display, an organic light-emitting diode (OLED) display, touchscreen, cathode ray tube (CRT) monitor, projector, or other display device), a printer, external storage, or any other output device. One or more of the output devices may be the same or different from the input device(s). Many different types of computing systems exist, and the aforementioned input and output device(s) may take other forms.

The computer (502) can serve in a role as a client, network component, a server, a database, or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud, fog, or edge-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether illustrated, or) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502) including downhole or within a downhole investigation tool. Memory (506) can include non-persistent and persistent storage. The input and output device(s) may be locally or remotely connected to the computer processor(s) (505) and the memory (506).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), wherein each computer (502) communicates over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A method for determining a collapse pressure of a well using a drill stem test tool (DSTT), the method comprising:

deploying the DSTT via a drill string into a wellbore, the DSTT comprising a plurality of sensors;

isolating, using straddle packers, a zone of interest in the wellbore;

reducing and recording pressure inside the drill string which is in fluid communication with the wellbore;

recording acoustic emissions from the plurality of sensors disposed on the DSTT in the zone of interest while reducing pressure inside the drill string;

correlating the recordings of the acoustic emissions with the pressure inside the drill string;

processing, using a computer processor, the acoustic emissions;

using the processed acoustic emissions to determine a candidate sound of interest and a pressure at which the candidate sound of interest is recorded;

comparing the candidate sound of interest with a reference lookup table of known lithology classifications;

determining a lithology of the wellbore from the lookup table; and determining a collapse pressure of the wellbore using the lithology of the wellbore and the pressure at which the candidate sound of interest is recorded.

2. The method of claim 1, wherein the plurality of sensors disposed in the DSTT comprise at least one selected from the group consisting of: geophones and acoustic recorders.

3. The method of claim 2, further comprising: installing the geophones and/or acoustic recorders in multiple locations in the isolated zone of interest.

4. The method of claim 1, wherein the plurality of sensors comprise a fiber optic line to sense the acoustic emissions.

5. The method of claim 4, further comprising: wrapping a fiber optic line around the DSTT in the zone of interest to record the acoustic emissions.

6. The method of claim 1, wherein the plurality of sensors comprise a pressure gauge for measuring the pressure inside the drill string, and wherein the lookup table is stored in the pressure gauge.

7. The method of claim 1, wherein the pressure inside the drill string is reduced by opening a surface valve, causing fluid to flow out of the zone of interest up to the surface.

8. The method of claim 7, wherein the candidate sound of interest represents noise indicating collapse of a wall of the wellbore.

9. The method of claim 1, further comprising: deflating the straddle packers and increasing the pressure in the drill string upon completion of the use of the DSTT in the zone of interest.

10. A drill stem test tool (DSTT) disposed in a wellbore comprising:

a drill string with perforations;

an upper straddle packer and a lower straddle packer used to isolate a zone of interest in the wellbore;

a pressure gauge with a memory for recording pressure, wherein the pressure gauge is configured to measure pressure inside the drill string; and acoustic sensors distributed along a length of the drill string, wherein the acoustic sensors are configured to listen for acoustic emissions comprising a candidate sound of interest in the isolated zone of interest and record a pressure at which the candidate sound of interest is recorded;

wherein the DSTT is used to determine a collapse pressure of the wellbore using a lithology classification of the wellbore and the pressure at which the candidate sound of interest was recorded.

11. The DSTT of claim 10, wherein the acoustic sensors comprise a fiber optic line wrapped around the perforated drill string in the zone of interest for sensing the acoustic emissions.

12. The DSTT of claim 10, wherein the acoustic sensors comprising at least one of geophones and acoustic recorders for sensing the acoustic emissions in the zone of interest.

13. The DSTT of claim 10, wherein a look up table comprising lithology classifications is stored in the memory of the pressure gauge.

14. The DSTT of claim 10, wherein the pressure inside the drill string is reduced by opening a surface valve, causing fluid to flow out of the zone of interest up to the surface.

15. The DSTT of claim 10, wherein the candidate sound of interest represents noise indicating collapse of a wall of the wellbore.

16. The DSTT of claim 10, wherein the recordings of the acoustic emissions are correlated with a pressure inside the drill string.

* * * * *